United States Patent [19]

Howat

[11] 3,970,324

[45] July 20, 1976

[54] FOAM-FILLED, CELLULAR STRUCTURAL PRODUCT

[75] Inventor: Eric F. Howat, Federal Way, Wash.

[73] Assignee: American Marine Industries, Inc., Tacoma, Wash.

[22] Filed: Oct. 9, 1974

[21] Appl. No.: 513,412

Related U.S. Application Data

[62] Division of Ser. No. 338,254, March 5, 1973, abandoned.

[52] U.S. Cl. ..... 280/610; 156/78; 156/197; 156/242; 428/71; 428/73; 428/76; 428/117

[51] Int. Cl.[2] ..... A63C 5/00; A63C 5/12; B32B 3/12

[58] Field of Search ..... 280/11.13 L, 11.13 M, 280/11.13 S; 9/310 R; 161/68, 69, 110, 111; 156/197, 78, 79, 242; 428/116, 117, 118, 71, 73, 76

[56] References Cited

UNITED STATES PATENTS

| | | | |
|---|---|---|---|
| 1,974,279 | 9/1934 | Jones | 161/69 |
| 2,744,042 | 5/1956 | Pace | 156/197 |
| 3,132,874 | 5/1964 | Baudou | 280/11.13 L |
| 3,201,138 | 8/1965 | Brown, Jr. | 156/197 |
| 3,276,784 | 10/1966 | Anderson, Jr. | 156/197 |
| 3,519,523 | 7/1970 | Rodman et al. | 161/111 |
| 3,740,301 | 6/1973 | Manning et al. | 280/11.13 L |

FOREIGN PATENTS OR APPLICATIONS

| | | | |
|---|---|---|---|
| 1,290,278 | 3/1962 | France | 280/11.13 L |

*Primary Examiner*—Marion E. McCamish
*Assistant Examiner*—Charles E. Lipsey
*Attorney, Agent, or Firm*—Eugene D. Farley

[57] ABSTRACT

A structural product useful in making skis and other articles of manufacture includes a core comprising a multiplicity of cells of structural material arranged side by side with their axes substantially parallel to each other and their ends open. A quantity of foamed plastic fills the cells and is bonded to the walls thereof. A structural skin lies across at least one face of the core and is bonded to the open ends of the component cells, thereby rigidifying the product.

2 Claims, 18 Drawing Figures

FIG. 3
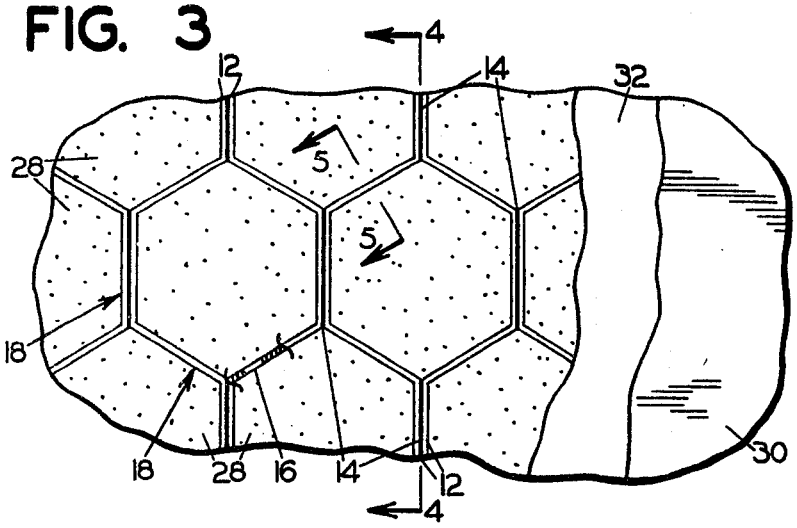
FIG. 1
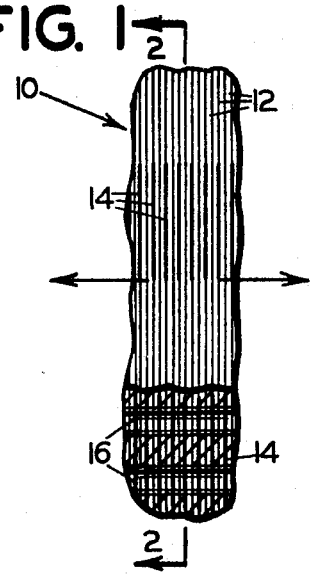
FIG. 2
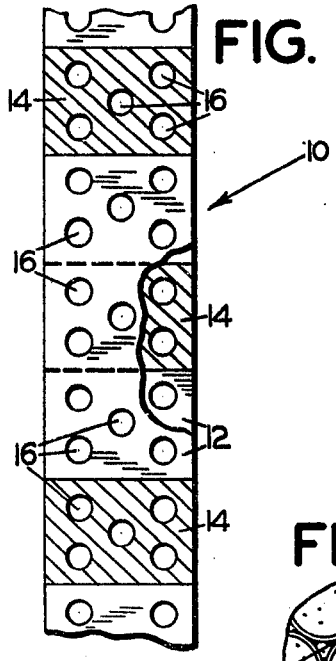
FIG. 4
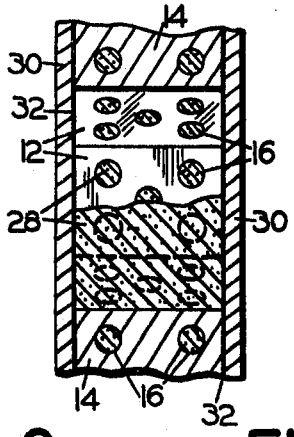
FIG. 8
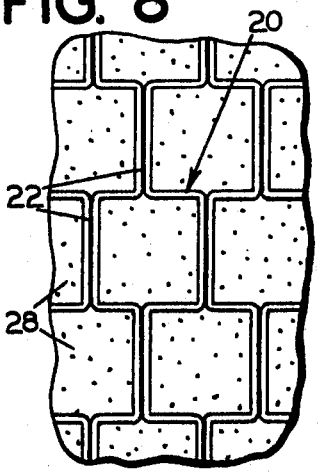
FIG. 9
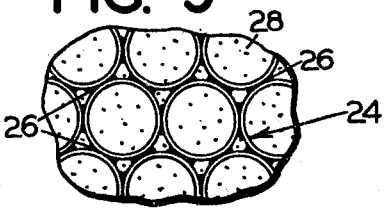
FIG. 6
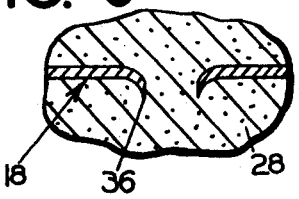
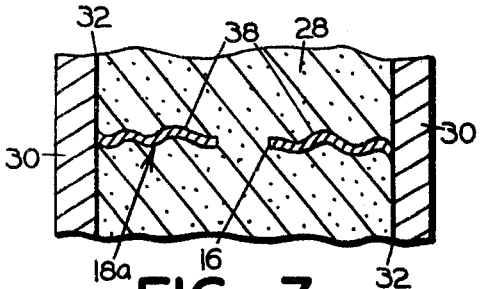
FIG. 7
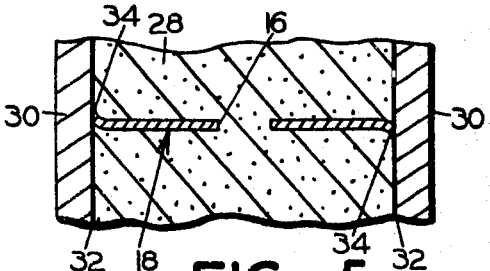
FIG. 5

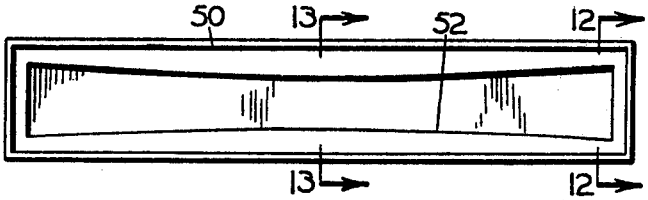
FIG. 10
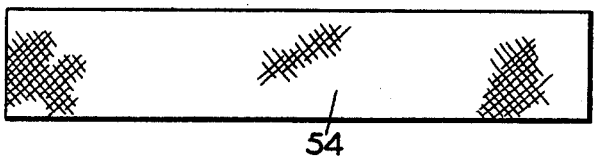
FIG. 11
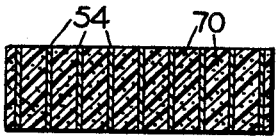
FIG. 13
FIG. 14
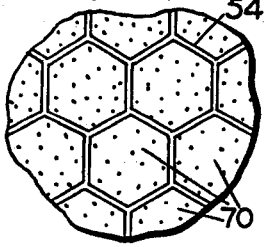
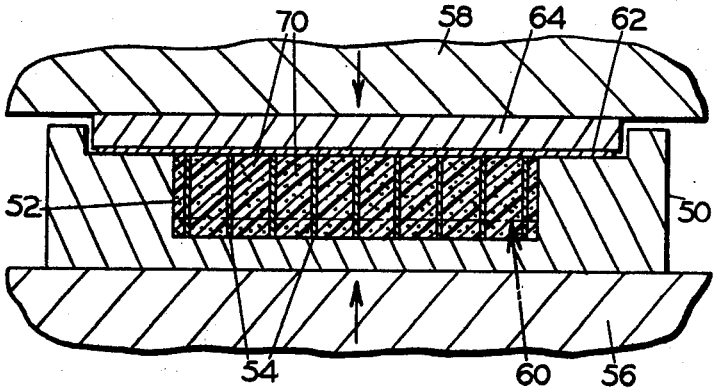
FIG. 12
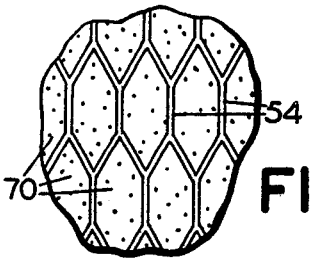
FIG. 15
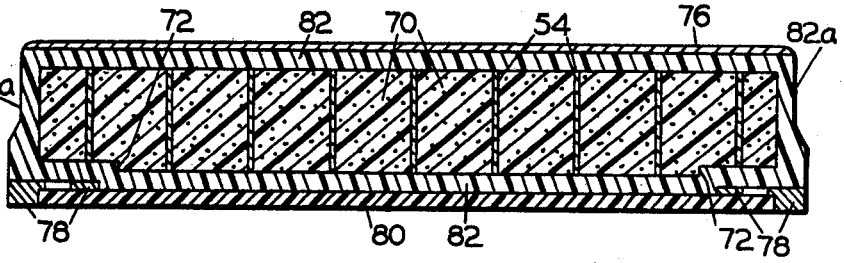
FIG. 16
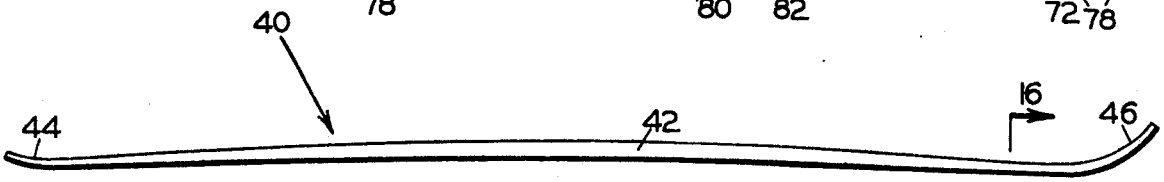
FIG. 18
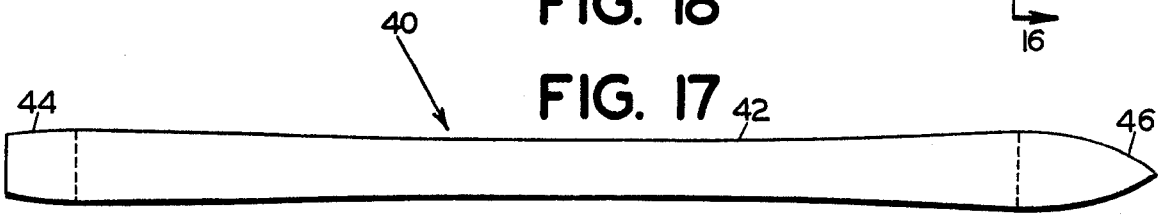
FIG. 17

FOAM-FILLED, CELLULAR STRUCTURAL PRODUCT

This is a division of application Ser. No. 338,254, filed Mar. 5, 1973, now abandoned.

This invention relates to structural products. It pertains in particular to laminar structural products comprising a foam-filled cellular core bonded to at least one structural skin.

The invention is particularly applicable to the manufacture of snow and water skis and is described herein with particular reference thereto, although no limitation thereby is intended, since it is applicable also to other uses including most hulls and panels, aircraft bodies and bulk heads, structural walls in buildings, etc.

The manufacture of snow skis presents particular problems because of the rigid requirements which must be met before the ski will perform satisfactorily. The ski overall must be light in weight but yet of adequate strength. The camber must be uniform in both skis of a pair. The ski should have a strong center, but flexible ends. Its flex must be permanent over long periods of use. It must possess a high degree of compressive strength. It must possess also adequate torque, i.e. the ability to bend in turns.

In times past skis conventionally were made of wood. This structural material is not completely satisfactory because of deficiencies with respect to one or more of the foregoing properties. Also, the properties are not reproducible, since different specimens of wood differ in density, grain structure, and relative proportions of hard grain vs. soft grain.

Modern skis accordingly are conventionally laminar in construction. With the advent of polyurethane and other foamed plastic materials, it has been proposed to incorporate such a foamed plastic as the core lamina of a light weight ski. This cannot be done successfully, since foamed plastic alone does not have adequate tensile strength to permit it to be bonded in the necessary manner to the surface laminae of the ski.

Under stress, the surface of the foamed plastic core merely breaks away from the body of the foam. Even though the bond between the foamed plastic core and the outer laminae is adequate, the unreinforced foam lacks the tensile strength to utilize fully the strength of the bonding agent.

Similarly, it is known to fabricate laminated products comprising expanded metal cores bonded between face sheets or skina. Such structures, too, have deficiencies as applied particularly to the manufacture of skis.

The expanded metal core normally is manufactured by gluing together sheets of aluminum or other light metal, the glue being applied in selected areas only. The sheets then are expanded by pulling the assembly apart.

In use, the glue bonds between the sheets, i.e. between the resulting cells of the expanded metal product, separate under stress, thereby destroying the product. Also, the expanded metal core cannot be sanded, ground, milled or planed. The core telegraphs the cell shape through the skin to give an unsightly appearance. Although top and bottom face sheets may be applied satisfactorily, side faces cannot since they will not bond satisfactorily to the side edges of the expanded metal core.

It accordingly is the general object of the present invention to provide a structural product and a method of manufacturing a structural product which is particularly useful in the manufacture of skis, structural panels, boat hulls, and the like which overcomes the foregoing problems in that it is rigid, machinable, light weight, of adequate torque and compressive strength, and has reproducibly uniform and substantially permanent flex qualities.

The foregoing and other objects of this invention are accomplished by the provision of a structural product which, essentially considered, comprises a cellular core comprising a multiplicity of tubular cells of structural material arranged side by side with their axes substantially parallel to each other and their ends open. A quantity of foamed plastic fills the cells and is bonded to the walls thereof. A structural skin is placed across the open ends of the cells on at least one side and is bonded to the ends of the walls thereof. Openings through the sides of the cells permit continuity of the foamed plastic. The density of cells may be varied across the area of the product as required to impart desired strength qualities.

Considering the foregoing in greater detail and with particular reference to the drawings wherein:

FIG. 1 is a fragmentary end view of an assembly of metal sheets bonded together in spaced locations and transversely perforated preliminary to expanding them in the manufacture of one of the important components of the hereindescribed structural product i.e. an expanded metal core therefor.

FIG. 2 is a longitudinal sectional view taken along line 2—2 of FIG. 1.

FIG. 3 is a fragmentary, detail, plan view of the structural product with the surface layers broken away, illustrating the construction of the core.

FIGS. 4 an 5 are fragmentary, detail, sectional views taken along lines 4—4 and 5—5 of FIG. 3, respectively.

FIGS. 6 and 7 are fragmentary, detail, sectional views illustrating alternate forms of cell walls which may be included in the cellular core.

FIGS. 8 and 9 are fragmentary, detail, plan views illustrating alternate shapes of the cells in cross section.

FIG. 10 is a schematic plan view of a mold which may be employed in the manufacture of a snow ski body by the hereindescribed method.

FIG. 11 is a schematic plan view of a cellular structure employed in the manufacture of the snow ski body.

FIG. 12 is a transverse sectional view illustrating the manner of producing the snow ski body in the mold of FIG. 10, taken along line 12—12 of that figure.

FIG. 13 is a transverse sectional view of the snow ski body taken along line 13—13 of FIG. 10, respectively.

FIGS. 14 and 15 are fragmentary, detail, plan views of the snow ski body taken in the vicinity of the terminal and central areas thereof, respectively.

FIG. 16 is a transverse sectional view illustrating the application of the snow ski body, the manufacture of which is illustrated in FIGS. 10–15 inclusive, to the manufacture of a snow ski, and FIGS. 17 and 18 are schematic views in plan and side elevation, respectively, of the finished ski.

As noted above, the hereindescribed structural product essentially comprises a cellular core filled with a quantity of foamed plastic bonded to the walls of the cells.

A variety of cellular materials may be employed as the cellular core. Thus the cells may be comprised of wood, paper, paperboard, plastic, or metal. They may assume various shapes, as rectangular, square, polygonal, or round. Expanded metal cores of hexagonal cross section are particularly well suited to the purposes of the invention.

The foamed plastic used to fill the cells may comprise any of the structural plastic materials which may be converted to the foamed condition, especially the foamed polyurethanes, polyesters and polystyrenes (Styrofoam). Such plastic materials lend themselves to a manufacturing process wherein the cellulose core is filled to a predetermined depth with the unfoamed plastic and catalyst. The resulting reaction product is a foam which rises to fill the cells while contemporaneously bonding the foam to the cell walls.

FIGS. 1–8 inclusive illustrate the structural product of the invention, its inherent characteristics and a preferred method for its manufacture.

In the embodiment of FIGS. 1–4, use is made of a cellular core of expanded metal. Such a core is particularly well suited for the purposes of the invention because of its ease of manufacture, light weight, high strength, and stability.

In FIG. 1 there is depicted the laminar blank from which the expanded metal cellular core is manufactured. It is indicated generally at 10 and consists of a plurality of laminae 12 each comprising a thin sheet of a metal such as aluminum, or other suitable material such as plastic or paper. The sheets are spotglued to each other by means of staggered applications of glue 14 in alternate layers. Preferably, for many uses the blank is drilled transversely to provide a plurality of transverse openings 16.

The unexpanded blank 10 next is pulled apart in known manner by the application of oppositely directed forces, indicated by the arrows of FIG. 1. This results in the production of a cellular core comprising a multiplicity of tubular cells arranged side by side with their axes substantially parallel to each other and their ends open. Where the cores comprise an expanded metal product, the cells 18 normally will be hexagonal in shape, as shown in FIG. 3.

However, where the cells are prepared by other procedures, they may assume different configurations. Thus, as illustrated in FIG. 8, the cells 20 may be rectangular or square in configuration and held together by glue or spot welding applications 22. Similarly, as shown in FIG. 9, the cells 24 may be round or oval in configuration and cemented together by applications of glue or spot welds 26.

Whatever their configuration, the cells are filled with foamed plastic, indicated at 28. The foam may be manufactured in situ by partly filling the individual cells with unfoamed plastic which is permitted to cure, thereby filling the cells and bonding to the sidewalls thereof. Where the cell walls are provided with a multiplicity of transverse perforations 16, the foam as it is produced will fill the perforations as well as the cells themselves.

The perforations permit free flow of the foam between the cells. This assists in achieving an even distribution of the foamed product. It also adds strength to the resulting cellular product by bridging through the common faces of each cell. Still further, by the removal of relatively heavy material, the perforations in the cell walls also reduce the total weight of the finished product.

The net result of combining the cellular core with the foamed plastic bonded to the component cell walls is to produce a structural product of greatly improved strength in compression, shear and torsion. The foamed plastic stabilizes the structure against deformation. The cellular structure cooperates by resisting tearing apart of the foamed plastic. The final product accordingly is stable and resists crushing, pulverizing and tearing apart.

Furthermore, the combination of cellular core and foamed plastic provides a surface which because of its stability and strength may be shaped as desired using conventional tools. It may be sawn, ground, milled, routed, or planed to any desired contour while still retaining its original quality of stability and continuity.

Still a further advantage of the combination of cellular core and foamed plastic filler is that it lends itself ideally to the application of overlays. This is true not only of laminar sheets which may be used to overlay the faces of the component cells of the product, but also to laminae which may be applied to the side faces thereof.

Thus, as illustrated particularly in FIG. 4, face sheets 30 may be applied across one or both of the core faces in a plane substantially normal to the longitudinal axes of the cells. The face sheets may comprise paper, wood, fabric, metal, plastic or cloth. They normally are secured by applying to their inner faces a layer 32 of suitable adhesive and holding them in contact with the core faces until the adhesive has set.

During this procedure, the adhesive will bond not only to the foamed plastic filler, which has little strength, but also to the ends of the cell walls, which are of substantial strength. The foamed plastic filler backs up the face sheets, so that the ends of the cell walls do not "telegraph through" the face sheets, and impart an unsightly appearance to the product.

Although the structural product prepared in the foregoing manner possesses substantial strength and stability, both of these important properties may be improved materially by the application of the variants illustrated in FIGS. 5, 6 and 7.

As shown in FIG. 5, the ends of the cell walls may be upset either before or after expanding of the metal blank to produce flanged areas or flat surfaces 34 wich lie substantially in the planes of face sheets 30. They thus afford a greater area for bonding the face sheets to the core and improve the strength and stability of the assembled product accordingly.

As shown in FIG. 6, the walls of cell 18 are provided with transverse perforations having spurred flanges 36 which extend laterally into the body of the foamed plastic. These serve as anchors which prevent displacement of the cells relative to the foamed plastic and greatly increase the stability of the product.

The stability of the product also is increased by the expedient illustrated in FIG. 7. In this form of the invention, the walls of cells 18*a* are provided with corrugations 38 which, like flanges 36 of the embodiment of FIG. 6, prevent relative displacement of the cells and foamed plastic, thereby increasing the stability of the product.

The advantages of the invention enumerated and explained above may be applied to advantage in the manufacture of skis, particularly snow skis, in the manner illustrated in FIGS. 10–18, inclusive.

As is particularly apparent from a consideration of FIGS. 17 and 18, the conventional snow ski indicated generally at 40 comprises a body portion 42, a tail piece 44 and a tip 46. It is to be noted particularly that the body portion must be strong in the center, but flexible at the ends. In plan, the body has a relatively narrow waist in the central portion. In side elevation, it is thicker in the center than at the ends. It also is shaped with a central arch which gives to it the desired flexible, concave contour.

As has been indicated, it would be desirable to manufacture a ski of a laminate having a foam-filled core since the resulting ski would be very light and less fatiguing to use. The foam per se, however, does not have the requisite strength. The cellular core per se does not have the requisite properties of machineability and stability so that a ski of the desired contour may be manufactured. However, the presently described combination of cellular core and foamed plastic ideally suits the purpose. Furthermore, it lends itself admirably to the fabrication of skis by conventional assembling methods.

To apply the hereindescribed technique to the manufacture of skis, there is provided a mold illustrated at 50 of FIG. 10. The mold has a bottom, two ends and two sides, but is open at the top. It is formed with a central cavity 52 which assumes the contour of the body portion of the ski. Thus it is narrower in the central portion than at the ends, to give the desired waist configuration.

In the first step of the procedure, a rectangular piece of cellular core material, for example, a piece 54 of expanded metal, is cut substantially to the length of the mold. However, it preferably has a width slightly greater than the width of the mold, even at the relatively wide ends of the latter.

Because of the compressible character of the cellular material, it may be compressed laterally selectively along its length sufficiently so that it may be inserted into cavity 52 of the mold. This has two desirable effects.

First, it fits the material snugly in the mold so that it completely fills the latter. Second, it creates a different density of cells in the ends of the ski body than exists in the central portion thereof.

This is illustrated in FIGS. 12 and 13, from a consideration of which it is apparent that the cells are wider at the ends of the ski body than the central portion thereof. It also is illustrated in FIGS. 14 and 15 wherein it is indicated that at the wide ends of the ski body the cells are fully expanded to a uniformly hexagonal configuration (FIG. 14) whereas at the midsection thereof the cells are compressed laterally to an elongated configuration (FIG. 15). This has the significant advantage of rendering the ski body stiff in the central portion where stiffness is required, but flexible at the ends, where flexibility is required.

After core member 54 has been placed in the mold cavity, the mold is placed on the lower platen 56 of a press including also a relatively movable upper platen 58. A quantity of uncured, liquid, foamable plastic such as a polyurethane, polyester or polystyrene resin and a suitable catalyst therefor next is poured in the mold to a level 50 predetermined to supply sufficient plastic in the foamed condition to fill completely the individual cells.

A fibrous sheet 62 which permits the dissipation of air during the foaming of the plastic, and a cover plate 64 successively are superimposed. The platens of the press are brought together until restraining pressure is just applied.

Foaming of the plastic then occurs. The resulting foam spreads uniformly throughout the cells, traveling laterally through openings 16 of FIGS. 1–4.

After the foaming process is completed, the press is opened and the product removed or ejected from the mold, depending upon whether a release-type or injection-type mold has been employed.

The resulting body-forming part, or blank 70, is light and strong and has two primary advantages not possessed by the corresponding parts of the prior art made from similar materials: it can be machined and it possesses side edges having structural integrity.

Accordingly, in the next step of the procedure the body part 70 is machined to the appropriate contour. Its ends are sanded or planed to give them the desired taper and flexibility. Its central portion as viewed in plan is planed or milled to impart the desired waist configuration. Its bottom longitudinal margins are routed out to provide recesses 72.

The contoured body part next is employed in the fabrication of the finished ski by substantially conventional methods.

It is wrapped with unidirectional fiberglass strands impregnated with epoxy or other suitable resin and assembled in a suitable mold with the other ski components, i.e. tail piece 44, tip 46, a wood or plastic top plate 76, metal edges 78, and plastic bottom lamina or runner 80. Setting of the epoxy resin in the mold integrates these materials into the finished ski while at the same time providing a strong fiberglass case 82 having integral side edges 82a. The latter are of sufficient durability to serve per se as the side edges of the ski.

The ski then is removed from the mold and finished up in the usual manner, whereupon it is ready for the marketplace.

Having thus described my invention in preferred embodiments, I claim as new:

1. A ski comprising in combination, body, tip and tail portions, the body portion being elongated and narrower in its central portion than at its ends and comprising a. a cellular core comprising a multiplicity of tubular laterally closed cells of structural material arranged side-by-side with their axes substantially parallel to each other and their ends open, the tubular cells being of progressively increasing density from the wider to the narrower lateral dimensions, b. a quantity of foamed plastic contained in the cells substantially filled the same and bonded to the walls thereof, c. a fiberglass sheet resin-bonded to and encasing the core and the tip and tail portions, and d. top and bottom surface sheets bonded respectively to the top and bottom surfaces of the fiberglass sheet, said surface sheets providing the top and bottom faces of the ski.

2. The method of making a ski, comprising:

a. providing a mold in the form of a ski body and having a bottom, side walls, end walls and an open top, the mold being narrower at its central portion than at its ends, b. providing a cellular core providing a multiplicity of tubular laterally closed cells of structural material arranged side-by-side with their axes substantially parallel to each other and their ends open, c. placing the cellular core in the mold with the open ends disposed outwardly and with the laterally closed cells collapsed laterally in proportion to the width of the mold, the cells being collapsed to a greater degree in the narrow area of the mold, d. placing a quantity of liquid, uncured, foamable plastic in unfoamed condition in the mold, e. effectuating the foaming and setting of the plastic to form a rigid, foamed ski body blank, f. removing the ski body blank from the mold, and g. encasing the ski body blank in a resin-bonded fiberglass sheet while contemporaneously bonding to the top and bottom faces of the sheet laminar sheets providing the top and bottom faces of the ski.

* * * * *